US011135117B2

(12) United States Patent
Miller

(10) Patent No.: US 11,135,117 B2
(45) Date of Patent: Oct. 5, 2021

(54) HOOP FOR SELF-APPLIED CHIROPRACTIC CARE

(71) Applicant: Edward W Miller, Salem, OR (US)

(72) Inventor: Edward W Miller, Salem, OR (US)

( * ) Notice: Subject to any disclaimer, the term of this patent is extended or adjusted under 35 U.S.C. 154(b) by 500 days.

(21) Appl. No.: 15/902,847

(22) Filed: Feb. 22, 2018

(65) Prior Publication Data

US 2019/0254907 A1 Aug. 22, 2019

(51) Int. Cl.
*A61H 1/00* (2006.01)
*A61H 1/02* (2006.01)

(52) U.S. Cl.
CPC ..... *A61H 1/008* (2013.01); *A61H 1/0292* (2013.01)

(58) Field of Classification Search
CPC ..... A61H 1/008; A61H 1/0292; A61H 1/00; A61H 15/00; A61H 15/0092; A63B 1/00; A63B 17/00; A63B 17/002; A63B 17/004; A63B 21/02; A63B 21/0414; A63B 21/0421; A63B 21/0428; A63B 21/0435; A63B 21/0442; A63B 21/045; A63B 21/0455; A63B 21/05; A63B 21/055; A63B 21/40; A63B 21/4001; A63B 21/4003; A63B 21/4005; A63B 21/4007; A63B 21/4009; A63B 21/4011; A63B 21/4013; A63B 21/4015; A63B 21/4017; A63B 21/4019; A63B 21/4021; A63B 21/4023; A63B 23/00; A63B 23/02; A63B 23/0205; A63B 23/0211; A63B 23/0216; A63B 23/0222; A63B 23/0227; A63B 23/0233;
(Continued)

(56) References Cited

U.S. PATENT DOCUMENTS 2,280,274 A * 4/1942 Wildermuth ..... A61H 1/008 606/237
5,848,980 A * 12/1998 Demerais ..... A61H 23/02 601/46
2007/0167888 A1* 7/2007 Taylor ..... A61H 1/0292 601/103

* cited by examiner

*Primary Examiner* — Kendra D Carter
*Assistant Examiner* — Arielle Wolff
(74) *Attorney, Agent, or Firm* — Carl D. Crowell

(57) ABSTRACT

An apparatus for self-administering therapeutic pressure to provide chiropractic treatment to a user comprising a first and second side rails; wherein the first and the second side rails are parallel to each other, further the side rails comprises a fixable telescopic arrangement to fixedly adjust length of the side rails; a font cross rail, wherein the font cross rail acts as a thrust vector to provide desired pressure by the user; a back cross rail comprising at least one acupressure tip aligned substantially parallel to the side rails, wherein first and second side rails, the font cross rail and the back cross rail form a closed frame, whereby the adjustable side rails provide fixable adjustment of the frame depending on the user's needs. An upper cross rail, wherein the upper cross rail further comprises first padded upper rest points to act as a fulcrum between the font cross rail and the acupressure tip during the chiropractic treatment to a user's lower spinal area, whereby desired therapeutic pressure is self-administered by the user to provide chiropractic treatment to various body areas through the acupressure tip. In the preferred embodiment, this is through the use of the hoop formed by the rails that extends around the body and is held in front of the self-treating person, with the angles of the side rails extending down the side presenting a ready measure of the angle of the treating instrument on the spine.

8 Claims, 6 Drawing Sheets

(58) Field of Classification Search
CPC ..... A63B 23/0238; A63B 2023/003; A63B 2023/006
See application file for complete search history.

HOOP FOR SELF-APPLIED CHIROPRACTIC CARE

FIELD OF THE INVENTION

The present invention pertains generally to a chiropractic instrument, and more particularly is focused on providing a device to permit self-applied treatment and the alignment and application of chiropractic therapies such as impact therapies to the spine and back area.

BACKGROUND OF THE INVENTION

Healthy muscles are soft, flexible and well nourished by blood flow in the circulatory system. A decrease in the blood flow reduces the temperature of the muscle tissue and the oxygen and nutrient supply to the tissue. Muscles which are overworked or otherwise subjected to a reduction in temperature and in levels of oxygen and nutrients tend to become tense and painful. Conversely, increasing the blood flow to muscle tissue tends to reduce tension and pain in muscles exhibiting such conditions and reduce the likelihood of development of such conditions in other muscles. The application of acupressure or impact therapies at specific locations proximate the selected tissue increases the blood flow to selected muscle tissue and facilitates myofascial release, reducing pain and improving mobility. The application of such pressure is therefore useful in reducing and preventing muscle tension and pain resulting from reduced blood flow and related issues in tissue.

Generally, acupressure and impact therapies techniques require a second person to apply acupressure to muscle sites that are difficult to reach such as in the neck, shoulders, back, hip and buttocks or to skeletal points such as specific vertebrae. The requirement for another person can be relatively inconvenient as such a person may be unavailable when therapy is desired. Moreover, the costs of having a trained therapist or other professional apply pressure can become expensive and inconvenient particularly when frequent treatments are needed. Finally, often treatments require the treated person to provide direction and feedback to the second person to ensure accurate application of therapies.

Numerous innovations have been provided in prior art that are adapted to apply acupressure to muscle and skeletal sites, including for self-application. Even though these innovations may be suitable for the specific purposes to which they address, they would not be as suitable for the purposes of the present invention as they generally fail to address the specific needs met by the invention disclosed herein.

For example, U.S. Pat. No. 4,037,590 to Dohring et al. discloses a point pressure therapy device comprising a rotatable ball of desired size, to be pressed against the skin of a patient in an area requiring therapy. The pressure and rotation speed of the ball is controlled by an electrical system. But this device is not efficient in self-acupressure therapy as this device cannot be accurately positioned by the user in the areas such as the back, being designed to be used by an individual to treat others.

For example, U.S. Pat. No. 5,094,227 to Eglauf et al. discloses a non-invasive pain relief apparatus, which mechanically applies and maintains pressure to a pressure point to relieve pain. The device includes a locking mechanism to lock an adjustable clamp to a selected position to apply a selected amount of pressure and a fine-tuning mechanism to precisely adjust the amount of pressure. However this device is not efficient in self-acupressure therapy in the manner of the disclosed device as the Eglauf clamp is limited to distal portions of the body that can be clamped such as a hand or foot, and Eglauf cannot be used for adjusting angular impact therapies as it is designed to be set and left in place.

For example, U.S. Pat. No. 4,716,898 to Chauve et al. discloses an apparatus for self-administration of acupressure includes a belt assembly. The belt, as it is drawn in about an individual, urges a pressure member extending radially inward from the belt into contact with a pressure point. However the device is not designed to permit ready adjustment nor allow the angle of impact to be dynamically adjusted during treatment.

For example, U.S. Pat. No. 4,944,747 to Newth et al. discloses a self-operated hand actuated tool for pain therapy. This tool comprises a slightly curved elongated handle that includes a round protrusion and an eyehook. A flexible strap is provided through the eyehook to thereby provide a flexible connection to the hand tool. However the Newth device does not permit percussive or impact therapies and is designed for applied continuous pressure.

For example, U.S. Pat. No. 4,520,798 to Lewis discloses a self-acupressure apparatus and method wherein pressure may be applied to various areas of the body in order to provide temporary relief of certain ailments. The apparatus comprises a plate vertically mounted on a wall structure. A bar secured to the opposite end of the arm and extending outwardly therefrom, and a knob member removably attached to the remote free end of the bar. The method comprises, adjusting the arm to position the knob member in contact with the treatment body area, and then applying pressure intermittently to the body area by the knob member. However the Lewis device does not permit percussive or impact therapies nor allow the angle of impact to by dynamically adjusted during treatment.

For example, U.S. Pat. No. 3,403,674 to Alimanestiano discloses a massaging machine that comprises a frame supporting for a carriage for movement over an individual disposed on the frame. The carriage mounts hand elements thereon so that a motor carried by the frame actuates the carriage and the hand elements to provide a massaging action along the individual's body. However the Alimanestiano device does not permit percussive or impact therapies nor allow the angle of impact to by dynamically adjusted during treatment.

For example, U.S. Pat. No. 3,799,155 to Gerlich discloses a massaging device comprising a substantially planar surface supported for transverse movement above an individual to be massaged. The surface has a plurality of massaging elements suspended therefrom for contacting the individual. A motorized unit reciprocates the surface relative to the individual to provide a massaging action. The Gerlich device does not permit percussive or impact therapies nor allow the angle of impact to by dynamically adjusted during treatment.

For example, U.S. Pat. No. 4,352,491 to Bellia discloses an exercise table having a semi-rigid support base supported for transverse rotation, two elongated rotational tubular members extending away from the base along the rotational axis of the base, and a rigid cushion disposed between the support base and the tubular members. The rigid cushion includes resilient spheres rotationally mounted therein. An individual sits on the semi-rigid support base with selected portions of the neck and back disposed between the resilient spheres. Then the individual then rocks the support base to apply varying pressure on the portions of the body supported on the spheres. The Bellia device, like many of the others does not permit percussive or impact therapies nor allow the angle of impact to by dynamically adjusted during treatment.

For example, U.S. Pat. No. 4,662,363 to Romano et al. discloses a device that comprises a plurality of acupressure probes positioned within a frame for contacting an individual on a support surface. Each probe is adjusted to conform to the contours of the individual disposed under the probes. In use a second person bears down on the probe to apply the proper pressure and then locks the probe in place. While the device disclosed by Romano et al. allows the second person to see and do other things, the individual is "pinned" to the support surface until the second person returns. Additionally, the individual has no control over the treatment.

For example, U.S. Pat. No. 4,924,859 to Pajevic discloses a body stimulating and massaging device comprising a plurality of spheroidal silicon rubber members secured along a cable supported in a serpentine fashion between a plurality of pulleys. The ends of the cable attach to a reciprocating motor through a shock absorbing tension assembly. The motor causes the spheroidal members to be drawn back and forth along a body disposed on top of them. The Bellia device, like many of the others does not permit percussive or impact therapies nor allow the angle of impact to by dynamically adjusted during treatment.

For example, U.S. Pat. No. 5,024,215 to Wang discloses a back rack for alleviating musculo-skeletal tension that includes a ramp with a pair of curved projections at its upper end to apply pressure to an individual's neck and skeletal areas. Levers connected to a supporting base of the ramp move from a vertical position to apply pressure and relieve tension in the shoulders. Pins inserted in the ramp proximate the neck and feet to relieve tension in the feet and neck. The Wang device, like many of the others does not permit percussive or impact therapies nor allow the angle of impact to by dynamically adjusted during treatment.

For example, U.S. Pat. No. 5,097,823 to Kempler discloses a mechanical massage to a patient oriented in a horizontal position. An inner carriage mounts for movement in tracks within an outer cage by a motor driven crank. A motor driven crankshaft raises above a patient and then releases horizontally-mounted levers or massage arms to drop by gravity onto the individual as the inner carriage moves to simulate a massage. The Kempler device does not provide true impact therapies nor does it enable an individual to control the duration, location and force applied to a selected area.

The foregoing references disclose devices for applying acupressure in the neck, back, buttocks and other sites that are difficult to reach. However, the foregoing references fail to provide a relatively simple apparatus suitable for the self-administration of acupressure to such areas, and more particularly none of the prior art permits the careful application of impact therapies to skeletal sites which requires specific control of both the pressure and angle of impact for effective therapies. Further, the prior art generally requires a person be prone or stationary, limiting their ability to move during treatment.

It is apparent numerous innovations related to self acupressure devices for applying pressure to affected areas of the user body by the user himself have been developed in the prior art that are adequate for various purposes. Furthermore, even though these innovations may be suitable for the specific purposes to which they address, they would not be suitable for the purposes of the present invention as heretofore described. Thus there is a need for an apparatus for applying acupressure and impact therapies in the neck, back, buttocks and other sites that are difficult to reach that can be self-administered by the user. There is further a need for such a device that allows the user to dynamically control the force applied and the angle of any force. The disclosed and claimed device meets these needs.

SUMMARY OF THE INVENTION

An object of the present invention is to provide a device that enables an individual to self-administer acupressure.

Another object of the present invention is to provide a device that enables an individual to self-administer impact therapies.

Another object of the present invention is to provide an acupressure device that is simple for inexperienced individuals to use and operate effectively.

Still another object of the present invention is to provide an acupressure apparatus that is relatively simple and inexpensive to manufacture.

Still yet another object of the present invention is to provide a device that enables an individual to self-stimulate a plurality of acupressure points located on the neck, shoulders, back, hips and buttocks in succession without repositioning and to do so efficiently.

Yet a further object of the present invention is to provide an acupressure apparatus that allows an individual to simply and effectively control the location, duration, and force of acupressure.

Yet a further object of the present invention is to provide an acupressure apparatus that allows an individual to move, bend or walk as therapies are applied.

Yet a further object of the present invention is to provide an acupressure apparatus that allows an individual to simply and effectively control the angel of impacts or pressure for any therapies.

Yet a further object of the present invention is to provide an acupressure apparatus that allows an individual to apply rotational forces for kneading therapies.

In accordance with this invention, the above objects are attained by an apparatus comprising an acupressure structure that applies pressure to the individual. Disclosed is a frame that is supported by the individual in a predetermined position. A therapy device with an acupressure tip is supported on the frame and enables the individual to move the acupressure tip from a first position to a second position thereby to apply therapies to a predetermined acupressure point.

According to an aspect of the present invention an apparatus for applying pressure at a predetermined point comprises a frame including a chest supporting unit that locates the back in a predetermined orientation facing an acupressure tip. The frame supports the acupressure tip for movement between first and second positions spaced from the chest support unit. A pair of cross rails connected to the frame allows the ready adjustment of the elevation and angle of any therapies applied to multiple points on the individual's back.

Other objectives and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
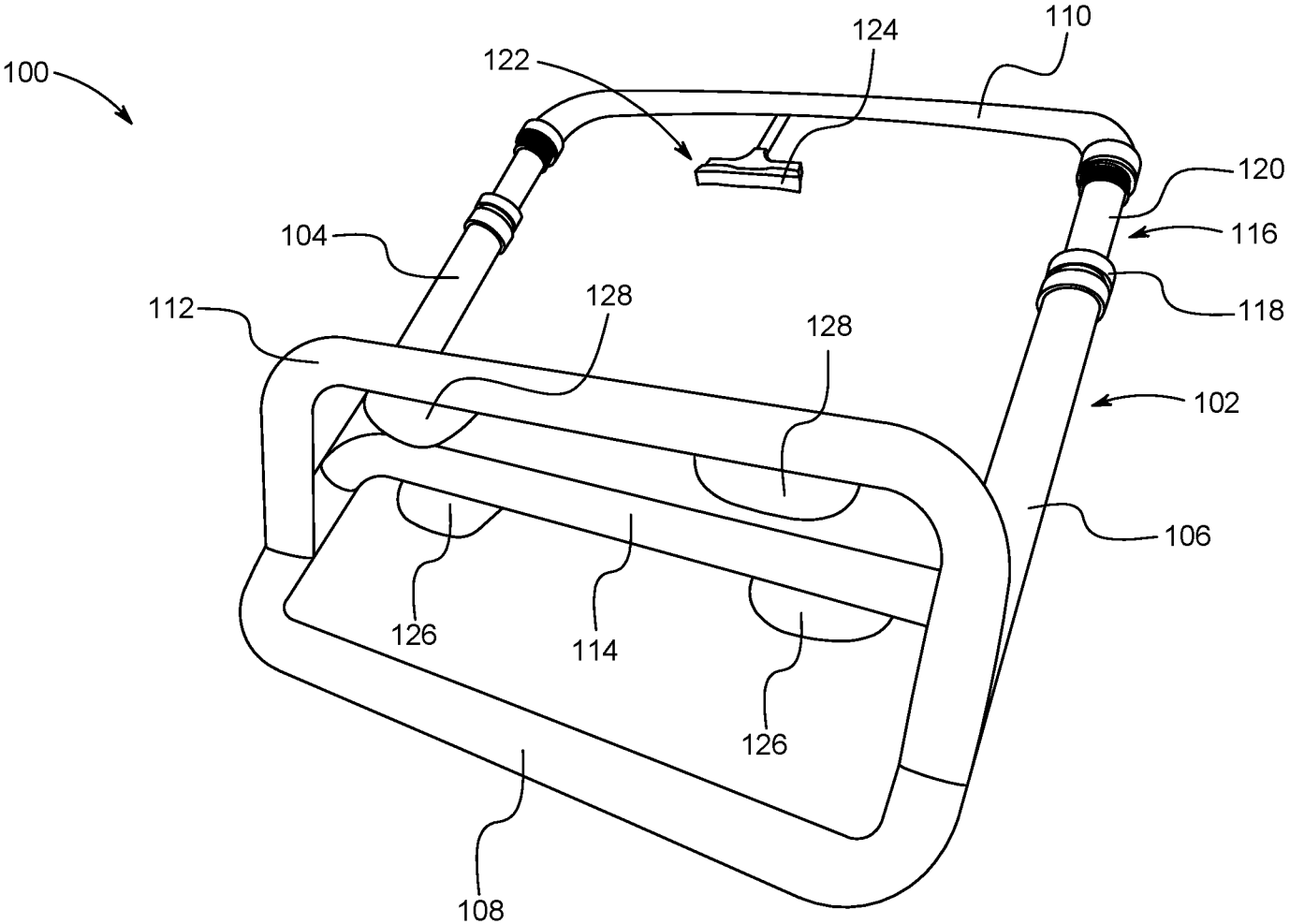
FIG. 1 illustrates a top perspective view of an exemplary embodiment of the present invention.
Figure 2:
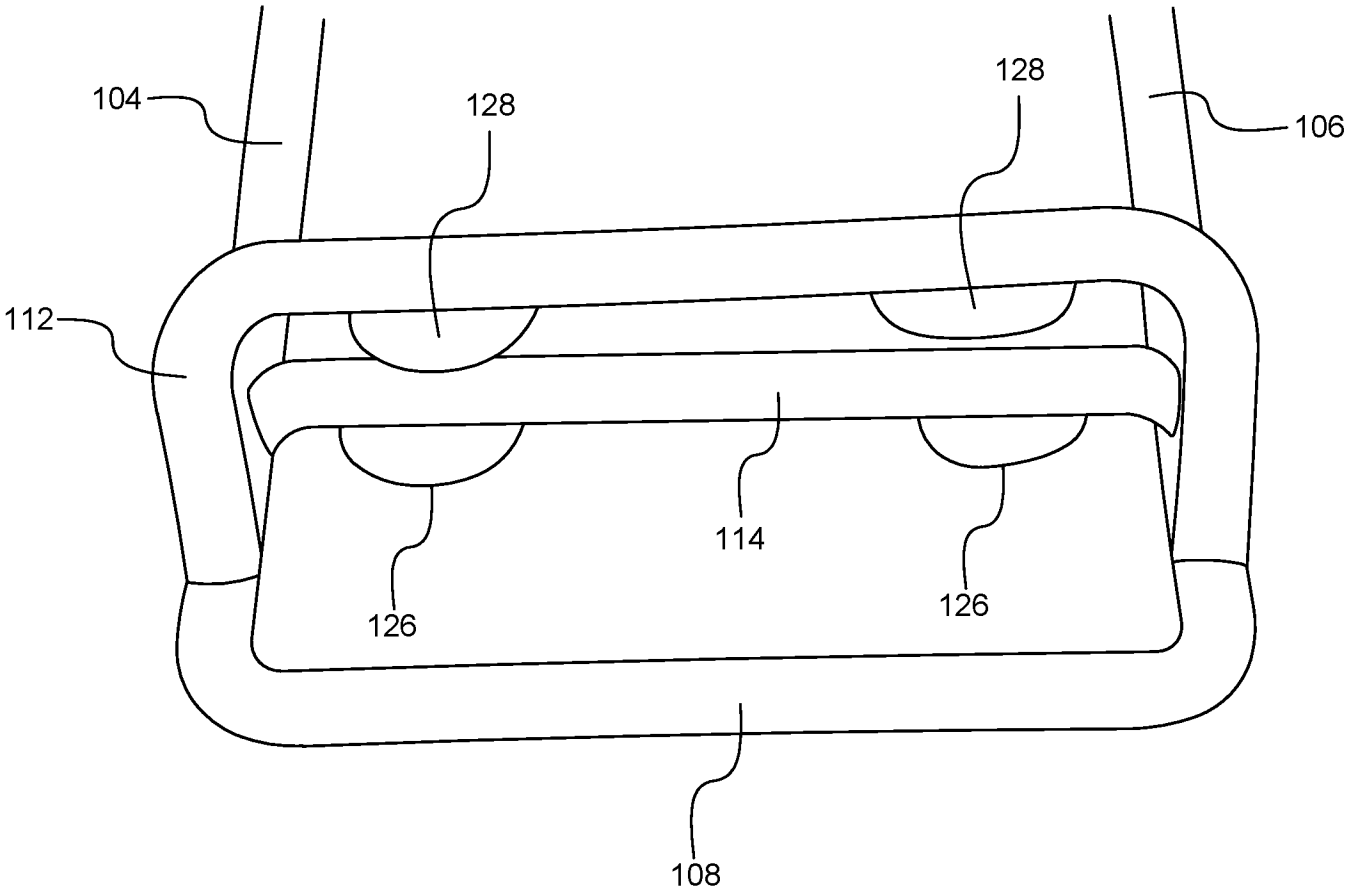
FIG. 2 illustrates a forward perspective view of the cross members of an exemplary embodiment of the present invention.

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts.

Figure 4:
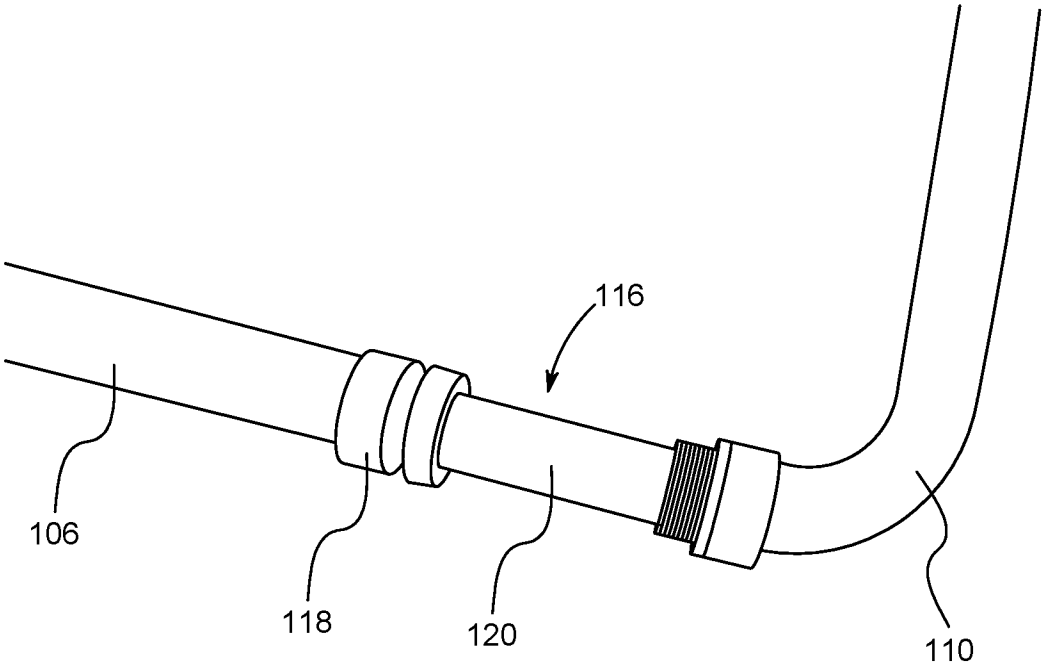
FIG. 4 illustrates a detail of a side member adjustment portion of an exemplary embodiment of the present invention.

As depicted in FIG. 1 in an exemplary embodiment of the disclosed invention showing an apparatus 100 for self-administering therapeutic pressure to provide chiropractic treatment to a user, wherein the apparatus 100 comprises a first side rail 106 and a second side rail 104 connected by front cross rail 108 and a back cross rail 110 thereby forming a closed frame 102. As shown in FIG. 4, the first side rail 106 and the second side rail 104 there are a pair of telescoping assemblies 116 disposed along the length of the side rails 106, 104 comprising an inner piston 120 that may slidably inserted into the forward portion of the side rails 106, 104. When the desired length of the side rails 106, 104 is set, then a locking means 118, such as a screw constrictor, may then set the length such that the set length is stable.

Traversing the closed frame are an upper cross rail 112 and a lower cross rail 114, each connected to the side rails 106, 104. Disposed on the lower portion of the upper cross rail 112, is a pair of upper padded forearm rests 128. Disposed on the lower portion of the lower cross rail 114, is a second pair of lower padded forearm rests 126.

Figure 3:
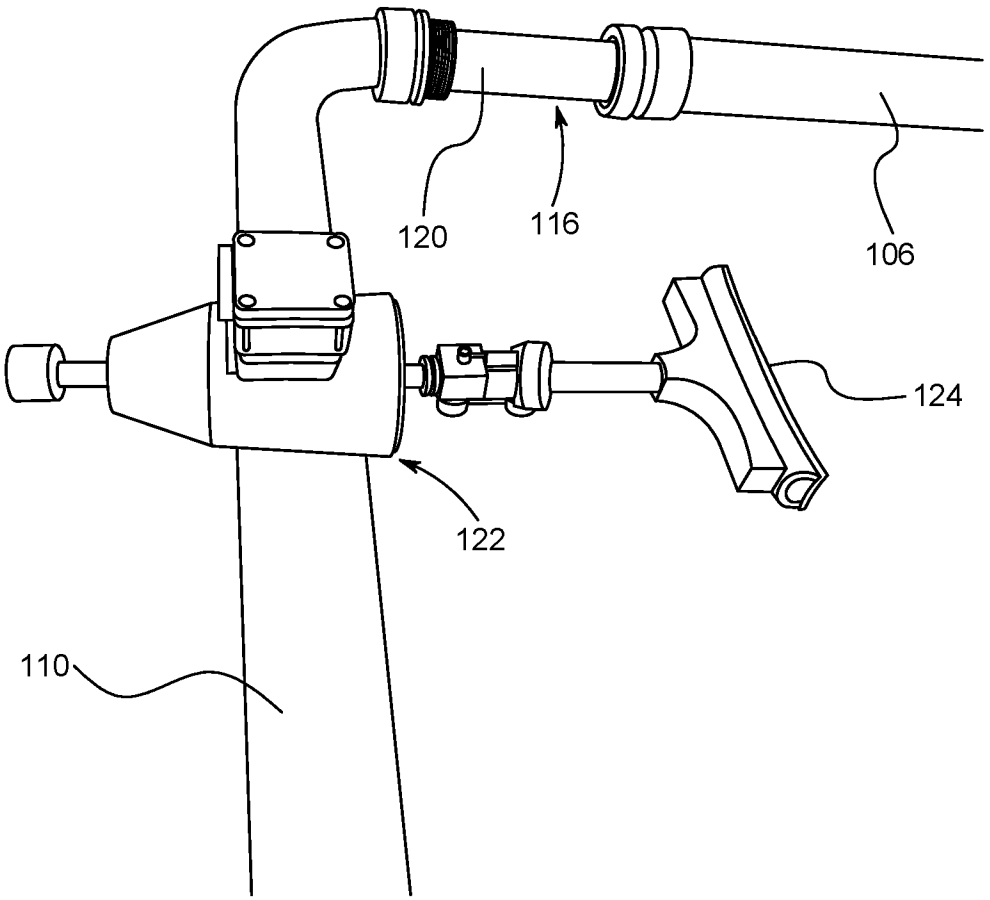
FIG. 3 illustrates a rear view of a therapy device such as an impact tool used in conjunction with an exemplary embodiment of the present invention.

Disposed medially on the back cross rail 110 is a percussive therapy device 122 with an acupressure tip 124 as illustrated in FIG. 3.

Figure 6:
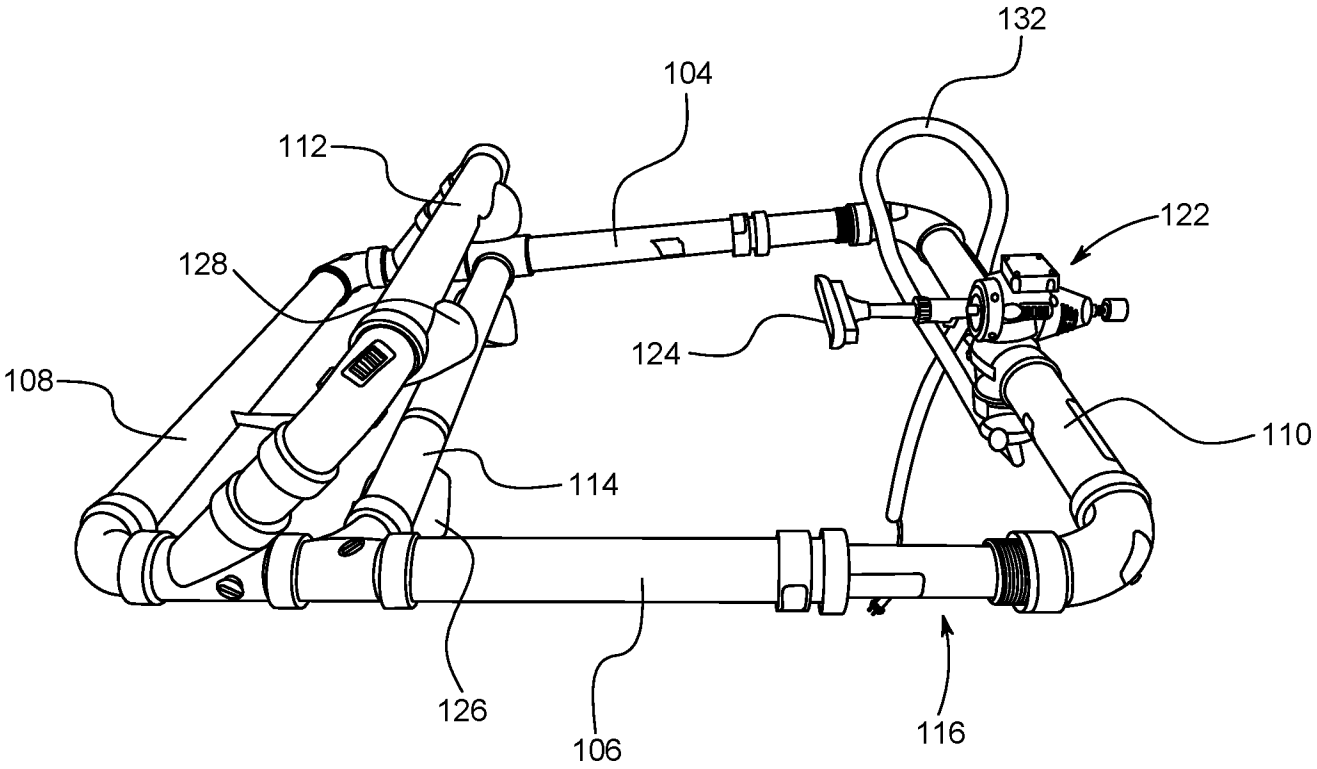
FIG. 6 illustrates a side perspective view of an exemplary embodiment of the present invention.

In construction the invention may be formed of plastics, lightweight tubing, or even standard off-the-shelf PVC components as depicted in FIG. 6. The padded forearm rests may be of neoprene, foam, or a combination of materials that will permit the weight of the invention to be readily supported on the forearms of the user without discomfort. The therapy device 122 affixed to the back cross rail 110 may be of the type commonly used for impact or acupressure therapies, including those such as the Arthrostim™ impact tool.

Figure 5A:
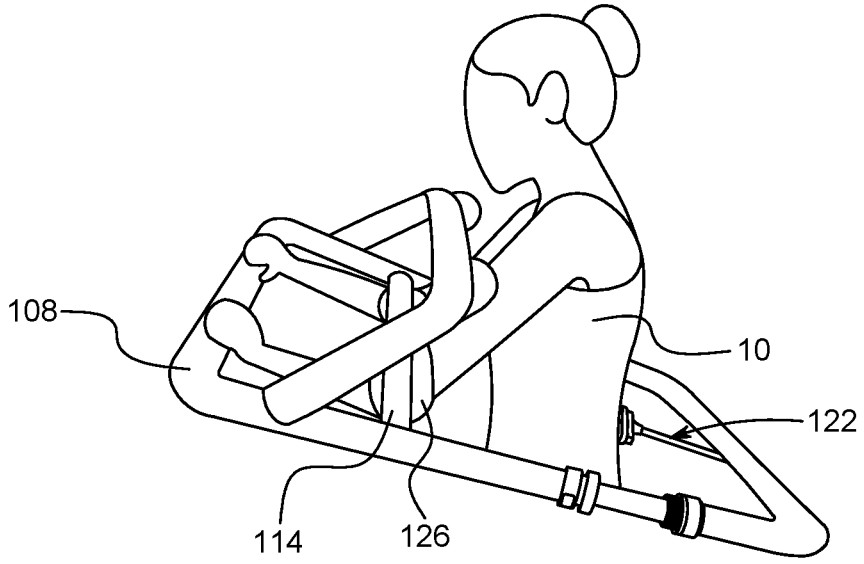
FIG. 5A illustrates a perspective view of an exemplary embodiment of the present invention in use with the lower cross members in use for support.

In operation the user 10 places themselves within the closed frame 102 and adjusted the side rails 104, 106 to the desired length to accommodate the size and shape of the user. Depending on the portion of the spine to be treated the user 10 places their arms under the lower cross rail 114 with the lower padded forearm rests 126 atop their arms and grasps the front cross rail 108 as depicted in FIG. 5A. The acupressure tip 124 may then me placed at the specific point and angle of impact desired for effective therapies.

Figure 5B:
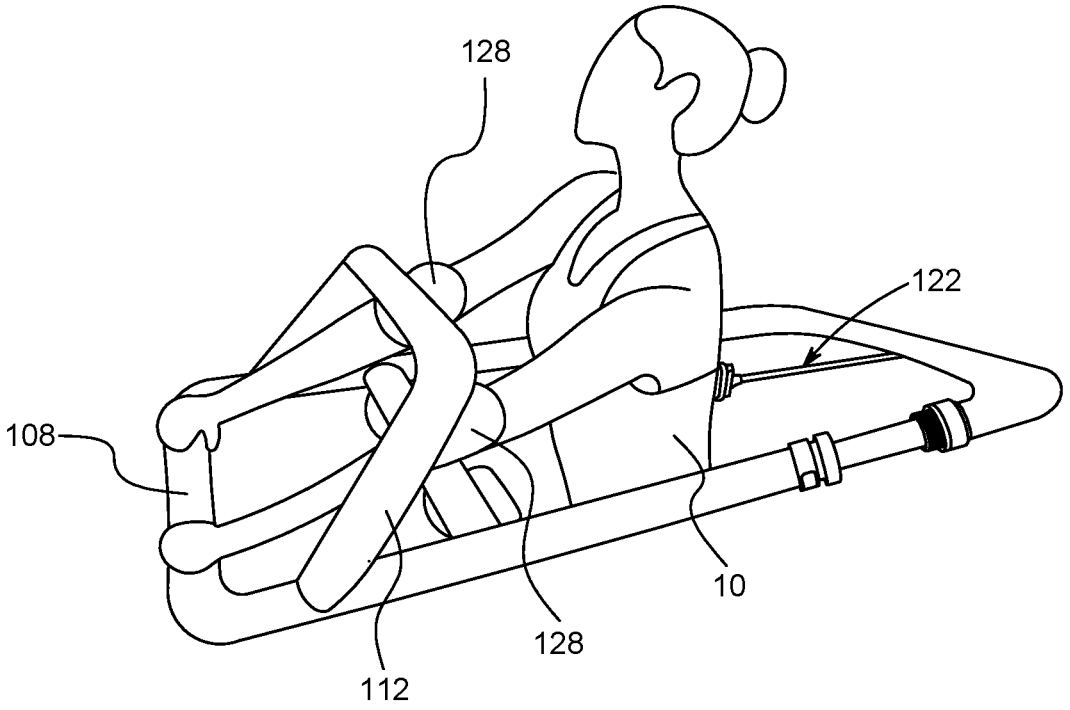
FIG. 5B illustrates a perspective view of an exemplary embodiment of the present invention in use with the upper cross members in use for support.

To permit better treatment of different areas of the back and different angles of impact, the user may elect to place their arms medially between the lower cross rail 114 and the upper cross rail 112 with the upper padded forearm rests 128 atop their arms and grasp the front cross rail 108 as depicted in FIG. 5B. Such a configuration permits the user 10 to better access different portions of their spine and at different angles for the incidence of impact and pressure therapies with the acupressure tip 124.

To permit treatment of different areas and to further facilitate different angles of pressure or impact, the user may elect to place one arm medially between the lower cross rail 114 and the upper cross rail 112 with the upper padded forearm rest 128 atop one arm grasping the front cross rail 108, with the second arm placed under the lower cross rail 114 with the lower padded forearm rest 126 atop the second arm grasping the front cross rail 108.

Further modifications may include additional rails connecting the upper cross rail 112 and lower cross rail 114 to provide additional points for a user to grip, in addition to the front cross rail.

To permit rotational or kneading treatments of different areas and to further facilitate different angles of pressure or impact, the user may elect to rotate and or move the cross rail 108 during the application of therapies, thus translating the movement and or rotation applied to the cross rail 108 to the acupressure tip 124 during treatment, broadening the scope of available therapies that may be self-administered.

As shown in FIG. 6, a cord 132 with a remote switch may be used to active the therapy device 122. As well, by applying forward pressure to the front cross rail 108, the user 10 has direct control over the force applied by the acupressure tip 124 on the spine and by raising and lowering the front cross rail 108, the closed frame 102 pivots on the users forearms permitting adjustments in angle and placement of the acupressure tip 124.

According to an aspect of the present invention as shown in FIGS. 1-6, an apparatus 100 for self-administering therapeutic pressure to provide chiropractic treatment to a user wherein the apparatus 100 comprises: a first side rail 106 and a second side rail 104; wherein said first side rail 106 and said second side rail 104 are parallel to each other, further said side rails 106,104 comprises a fixable telescopic assembly 116 to fixedly adjust length of said side rails 106,104; a font cross rail 108, wherein said font cross rail 108 acts as a thrust vector to provide desired pressure administered by the user; a back cross rail 110 with a therapy device 122 affixed thereto with at least one acupressure tip 124 aligned substantially parallel to the side rails 106,104, wherein said first and second side rails 106,104, said font cross rail 108 and said back cross rail 106 form a closed frame 102; a lower cross rail 114 disposed medially between said back cross rail 110 and said front cross rail 108 connecting said first and second side rails 106,104, wherein said lower cross rail 114 further comprises a pair of padded forearm rest points 126 to act as a fulcrum between said front cross rail 108 and said acupressure tip 124 during the chiropractic treatment to a user; and an upper cross rail 112, wherein said upper cross rail 112 is disposed medially between said back cross rail 110 and said front cross rail 108 connecting said first and second side rails 106,104, said upper cross rail 112 being displaced above said lower cross rail 114, wherein said upper cross rail 112 further comprises a pair of padded forearm rest points 128 to act as an alternate fulcrum between said font cross rail 108 and said acupressure tip 124 during the chiropractic treatment to a user, whereby the user electively place their arms and self-administer desired therapeutic pressure on the lower cross rail 114 or the upper cross rail 112 to provide chiropractic treatment to various body areas through the acupressure tip 124.

According to another aspect of the present invention, the telescopic assembly 116 comprises an inner piston 120 and a screw constrictor 118 to lock the inner piston 120 at a desired position to fixedly adjust length of the side rails 106,104.

According to another aspect of the present invention, the therapy device 122 is an impact tool including those such as the Arthrostim™ impact tool, wherein the therapy device 122 is wired 132 or wirelessly controlled by a remote controller or at least a remote switch.

These and other advantages of the invention will be further understood and appreciated by those skilled in the art by reference to the provided written specification, claims and appended drawings.

The foregoing detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described are exemplary implementations provided to enable persons skilled in the art to make or use the embodiments of the disclosure and are not intended to limit the scope of the disclosure, which is defined by the claims. For purposes of description herein, the terms such as "upper," "lower," "rear," "forward," and derivatives thereof shall relate to the invention as oriented in FIG. 1. Furthermore, there is no intention to be bound by any expressed or implied theory presented. It is also to be understood that the specific device and processes illustrated in the attached drawings, and described in the foregoing specification, are simply exemplary embodiments of the inventive concepts defined in the appended claims. Specific dimensions and other physical characteristics relating to the embodiments disclosed herein are therefore not to be considered as limiting, unless the claims expressly state otherwise.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. An apparatus for self-administering therapeutic pressure to provide chiropractic treatment to a user wherein the apparatus comprises:

a first side rail and a second side rail; wherein said first side rail and said second side rail are parallel to each other;

a front cross rail, wherein said front cross rail acts as a thrust vector to provide desired pressure by the user;

a back cross rail with a therapy device affixed thereto with at least one acupressure tip aligned substantially parallel to the side rails, wherein said first and second side rails, said front cross rail and said back cross rail form a closed frame; and a lower cross rail disposed medially between said back cross rail and said front cross rail connecting said first and second side rails;

an upper cross rail, wherein said upper cross rail is disposed medially between said back cross rail and said front cross rail connecting said first and second side rails, said upper cross rail being displaced above said lower cross rail, wherein said upper cross rail further comprises a pair of padded forearm rest points to act as an alternate fulcrum between said front cross rail and said at least one acupressure tip during the chiropractic treatment to a user;

wherein said lower cross rail further comprises a pair of padded forearm rest points to act as a fulcrum between said front cross rail and said at least one acupressure tip during the chiropractic treatment to a user, whereby the apparatus is configured to deliver self-administered desired therapeutic pressure to various body areas through said at least one acupressure tip.

2. The apparatus of claim 1 wherein said side rails comprise a fixable telescopic assembly to fixedly adjust a length of said side rails.

3. The apparatus of claim 2 wherein said telescopic assembly comprises an inner piston and a screw constrictor to lock said inner piston at a desired position to fixedly adjust the length of said side rails.

4. The apparatus of claim 1 wherein said therapy device is an impact tool.

5. An apparatus for self-administering therapeutic pressure to provide chiropractic treatment to a user wherein the apparatus comprises:

a first side rail and a second side rail; wherein said first side rail and said second side rail are parallel to each other;

a front cross rail, wherein said front cross rail acts as a thrust vector to provide desired pressure by the user;

a back cross rail with a therapy device affixed thereto with at least one acupressure tip aligned substantially parallel to the side rails, wherein said first and second side rails, said front cross rail and said back cross rail form a closed frame;

a lower cross rail disposed medially between said back cross rail and said front cross rail connecting said first and second side rails, wherein said lower cross rail further comprises a pair of padded forearm rest points to act as a fulcrum between said front cross rail and said at least one acupressure tip during the chiropractic treatment to a user; and an upper cross rail, wherein said upper cross rail is disposed medially between said back cross rail and said front cross rail connecting said first and second side rails, said upper cross rail being displaced above said lower cross rail, wherein said upper cross rail further comprises a pair of padded forearm rest points to act as an alternate fulcrum between said front cross rail and said at least one acupressure tip during the chiropractic treatment to a user, whereby the apparatus is configured to deliver self-administered desired therapeutic pressure through said lower cross rail or said upper cross rail to provide chiropractic treatment to various body areas through said at least one acupressure tip.

6. The apparatus of claim 5 wherein said side rails comprise a fixable telescopic assembly to fixedly adjust a length of said side rails.

7. The apparatus of claim 6 wherein the telescopic assembly comprises an inner piston and a screw constrictor to lock said inner piston at a desired position to fixedly adjust the length of said side rails.

8. The apparatus of claim 5 wherein the therapy device is an impact tool.

* * * * *